US006016663A

United States Patent [19]

Jeong

[11] Patent Number: 6,016,663

[45] Date of Patent: Jan. 25, 2000

[54] AUTOMATIC ICE MAKING APPARATUS FOR USE IN A REFRIGERATOR

[75] Inventor: Seon Yong Jeong, Incheon, Rep. of Korea

[73] Assignee: Daewoo Electronics Co., Ltd., Rep. of Korea

[21] Appl. No.: 09/150,730

[22] Filed: Sep. 10, 1998

[30] Foreign Application Priority Data

Dec. 13, 1997 [KR] Rep. of Korea ..... 97-68488

[51] Int. Cl.[7] ..... F25C 1/12

[52] U.S. Cl. ..... 62/347; 62/348

[58] Field of Search ..... 62/347, 348, 352

[56] References Cited

U.S. PATENT DOCUMENTS 4,641,501 2/1987 Simkens ..... 62/348

5,555,743 9/1996 Hatanaka ..... 62/347

5,904,054 5/1999 Lee ..... 62/347

*Primary Examiner*—William E. Tapolcai

*Attorney, Agent, or Firm*—Pennie & Edmonds LLP

[57] ABSTRACT

An automatic ice making apparatus for use in a refrigerator has a water regulation container capable of containing water therein and a pair of lateral holes formed on side portions of the water regulation container. The water regulation container is also provided with a drain hole formed through a bottom of the water regulation container and a second conduit through which the water in the water regulation container is delivered to a mold for defining a shape of an ice cube. A micro processor controls an opening and a closing states of the drain hole in such a way that the drain hole is opened for a predetermined time to be closed.

11 Claims, 8 Drawing Sheets

AUTOMATIC ICE MAKING APPARATUS FOR USE IN A REFRIGERATOR

FIELD OF THE INVENTION

The present invention relates to an automatic ice maker for use in a refrigerator; and, more particularly, to an automatic ice making apparatus incorporated therein a water amount limiter capable of repeatedly supplying a same amount of water to an ice maker, regardless of a standing uprightness thereof.

DESCRIPTION OF THE PRIOR ART

One of the well known refrigerators is provided with an automatic ice making apparatus wherein water supplied by a water supplying device to an ice mold rotatably installed is frozen to form an ice cube and then the ice cube is separated from the ice mold to be deposited into a subjacent restore bin.

For example, there is disclosed in FIG. 1 a refrigeration provided with an ice making apparatus. The ice making apparatus includes an ice maker installed in a freezing chamber 13 and a water supplying device 20. The water supplying device 20 is capable of repeatedly delivering a predetermined amount of, e.g., 105±15 CC to a mold 11. When the water supplied to the mold 11 is frozen to form an ice cube, the mold 11 is overturned to separate the ice cube therefrom, depositing it on a restore bin 12. The mold 11 is then overturned again to receive the water. These operations are repeatedly performed until a predetermined amount of the ice is collected in the restore bin 12.

In FIG. 2, the water supplying device 20 employed in the ice making apparatus in FIG. 1 is shown in detail. The water to be made into the ice cube is delivered to the mold 11 to a water container 21 from a detachable water reservoir 24 through an outlet 26. A valve 25 floats on the water contained in the water container 21 and closes the outlet 26 when a water level of the water contained in the water container 21 reaches a predetermined height. The predetermined amount of water kept in the water container 21 is delivered to the mold 11 via a supply conduit 19, when a water pump 23 is actuated by a water supply motor 22.

Although the water supplying device employed in the prior art ice making apparatus described above is capable of performing its assigned task, it has a shortcoming in that it is difficult to precisely regulate the amount of water supplied to the mold, since the level of water contained in the water container varies depending upon a standing uprightness of the refrigerator. That is, since the water kept in the water container is leveled depending upon the standing uprightness of the refrigerator, a time during the outlet is opened is changed with the standing uprightness of the refrigerator.

SUMMARY OF THE INVENTION

It is, therefore, a primary object of the invention to provide an automatic ice making apparatus equipped with a water amount limiter capable of repeatedly supplying a same amount of water to an ice maker, regardless of a standing uprightness of a refrigerator.

The above and other objects of the invention are accomplished by providing an automatic ice making apparatus for use in a refrigerator having a water reservoir, a freezing chamber within which an ice cube is made, a freezing device for generating a chill air within the freezing chamber and a mold mounted within the freezing chamber, said apparatus comprising: water limiting means capable of limiting water delivered thereto by keeping a predetermined amount of the water from the delivered water thereto, discarding the remainder, the water limiting means being located above the mold; water supplying means for supplying water in the water reservoir to the water limiting means; delivery means for providing a path through which the water kept in the water limiting means is delivered to the mold; and path control means for opening and closing said path.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

A preferred embodiment of an inventive automatic ice making apparatus is now described with reference to FIGS. 3 through 9.

Figure 1:
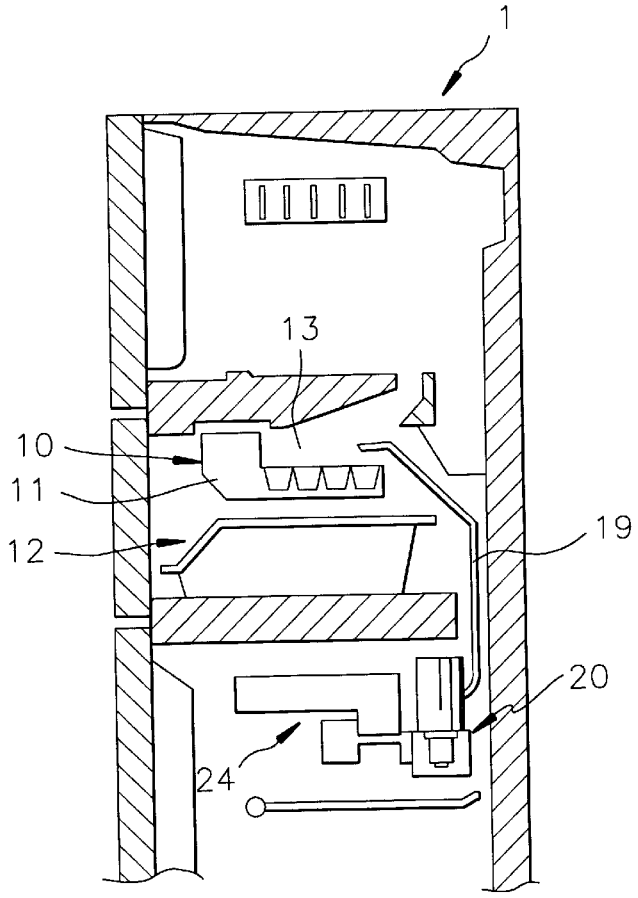
FIG. 1 (PRIOR ART)
FIG. 1 offers a side elevational view of the prior art automatic ice making apparatus for use in a refrigerator.
Figure 2:
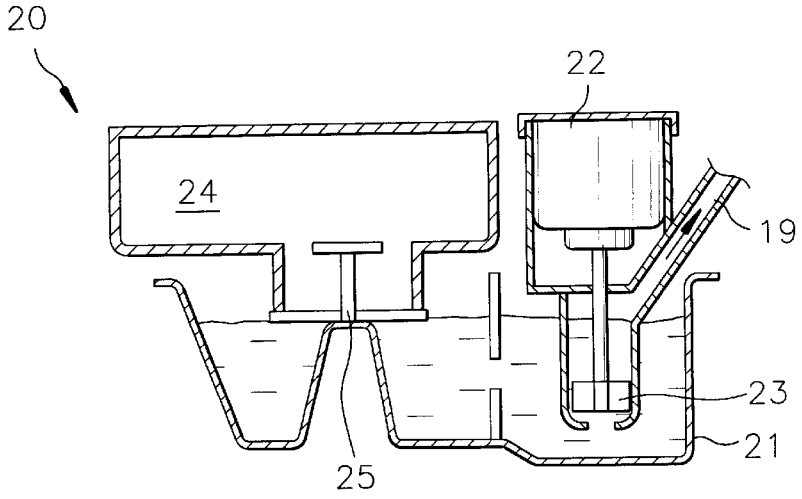
FIG. 2 (PRIOR ART)
FIG. 2 represents a sectional view of a water supplying device employed in the automatic ice making apparatus shown in FIG. 1.
Figure 3:
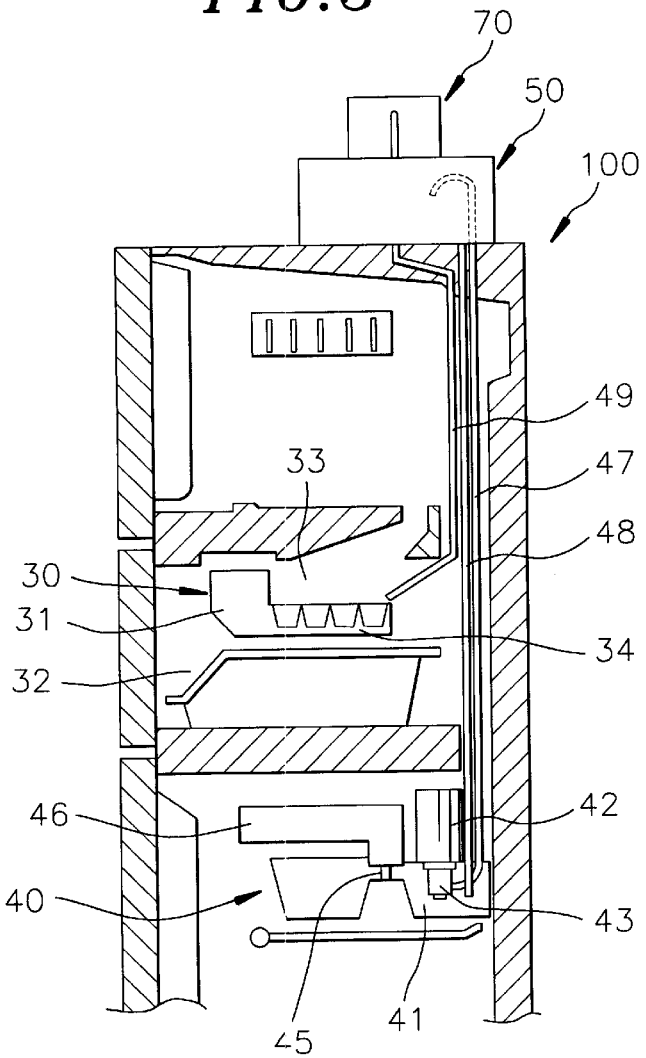
FIG. 3 gives a side elevational view of an automatic ice making apparatus in accordance with the present invention.

Referring to FIG. 3, there is shown a side elevational sectional view of an automatic ice making apparatus in accordance with the present invention. As shown, the automatic ice making apparatus is provided with an freezing device 30, a water supplying device 40, a water limiter 50, a link unit 60(see FIG. 4) and a switch box 70(see FIG. 4).

The freezing device 30 is installed in a freezing chamber 33 of a refrigerator 100 and functions to make an ice cube by generating a chill air within the freezing chamber. A mold 31 is rotatable between a freeze orientation for making the ice cube and a separation orientation, wherein the mold 31 is rotated 180° from the freeze orientation to separate the ice cube from the mold 31. The mold 31 to which the water limiter 50 delivers a predetermined amount of water has a plurality of partitions 34 for defining a shape of the ice cube.

The water supplying device 40 supplies the water into the water limiter 50. The water supplying device 40 has a water container 41, a water supply motor 42, a pump 43 and a water reservoir 46. The water reservoir 46 has an opening valve(not shown) which opens when the water reservoir 46 is installed within the refrigerator, and closes when the water reservoir 46 is removed. When the water reservoir 46 is installed within the refrigerator, the water within the water reservoir 41 flows into the water container 41. The water supply motor 42 and the pump 43 deliver the water in the water container 41 to the water limiter 50 via a first water supply conduit 47.

Figure 4:
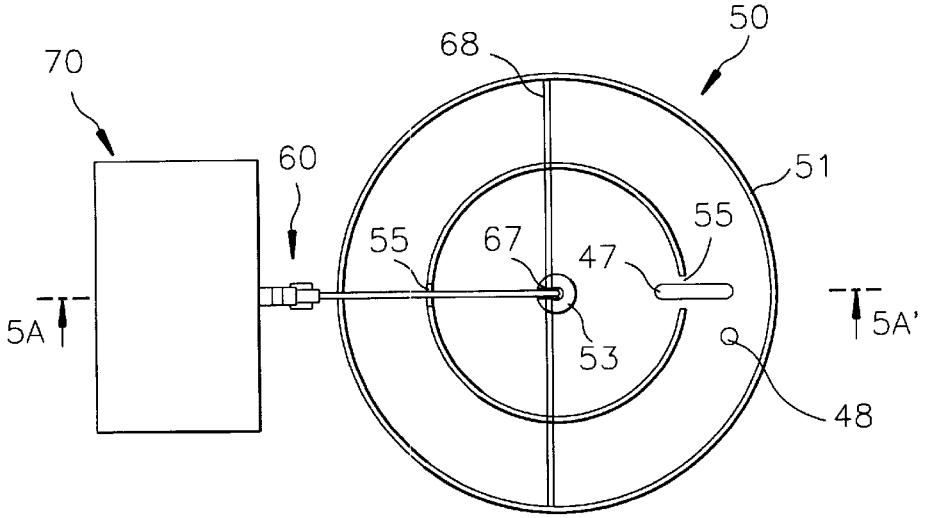
FIG. 4 shows a top planar sectional view of an inventive water limiter installed on an upper part of the refrigerator.
Figure 5A:
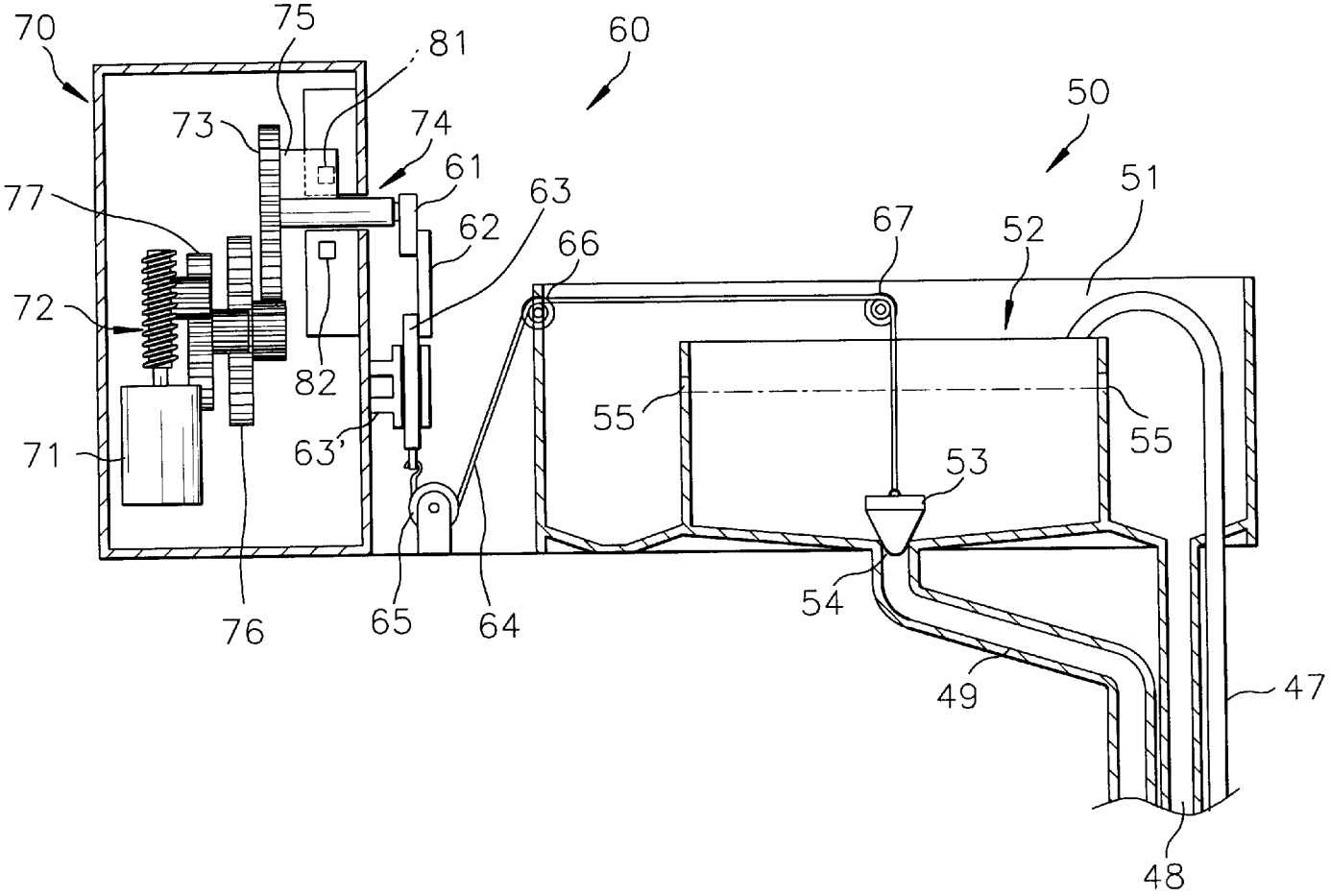
FIG. 5A illustrates a water limiter, a link and a switch box, when the refrigerator is viewed from a front thereof and a delivery valve is closed.

As shown in FIGS. 4 and 5A, the water limiter 50 is provided with an overflow container 51, a water regulation container 52, a recovery conduit 48 and a second water supply conduit 49. The water regulation container 52 keeps a predetermined amount of water therein to be supplied to the mold 31. For this function, a pair of opposed lateral through holes 55 are formed on side portions of the water regulation container 52, respectively. That is, the lateral through holes 55 are made in a left and a right sides of the water regulation container 52, when the refrigerator is viewed from the front thereof.

When the amount of water beyond the required amount in the mold 31 is supplied to the water regulation container 52 from the water container 41 via the first water supply conduit 47, only the required amount of the water is left in the water regulation container 52, with the rest being drained through the lateral through holes 55.

On the other hand, it is preferable that the lateral through holes 55 be positioned on a same height.

As a result of the presence of the lateral through holes of the water regulation container 52, a same amount of water is kept in the water kept in the water regulation container 52 whether the refrigerator stands upright or slanted.

A drain hole 54 through which the water kept in the water regulation container 52 is delivered to the mold 31 is formed through a bottom of the water regulation container 52. The drain hole 54 is opened or closed by a delivery valve 53. The delivery valve 53 is vertically movable between a closing state wherein the delivery valve 53 is in a lowest position to close the drain hole and an opened state wherein the delivery valve 53 is in an uppermost position to open said drain hole 54. The water drained from the water regulation container 52 via the drain hole 54 is supplied to the mold 31 via the second delivery conduit 49.

On the other hand, the overflow container 51 containing the water flowing through the lateral through holes from the water regulation container 52 is provided with the recovery conduit 48 in order to return the water therein to the water container 41.

Figure 5B:
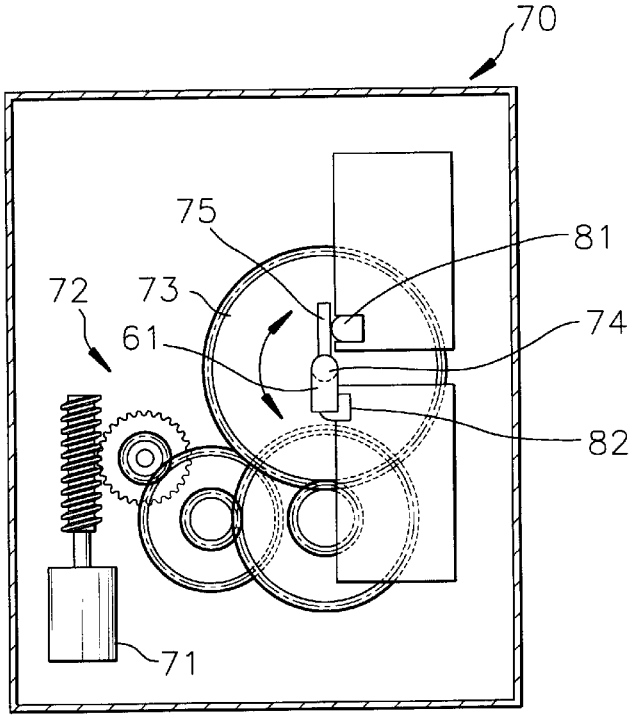
FIGS. 5B and 5C illustrate the switch box and a link employed in the inventive automatic ice making apparatus, respectively, when the delivery valve of the water limiter is closed.
Figure 5C:
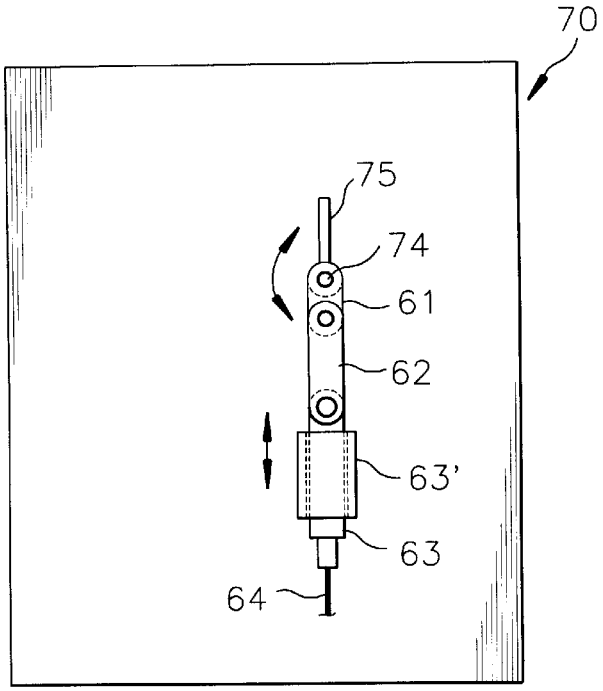

FIGS. 5A to 5C illustrate the link unit 40 and the switch box 70 employed in the inventive automatic ice making apparatus, when the delivery valve 53 of the water limiter 50 is closed.

Referring to FIG. 5A, the link device 60 includes a first guide roller 67, a second guide roller 66, a third guide roller 65, a wire 64, a rotational link 61, an intermediate link 62, a guide member 63' and a slider 63. The first and the second guide rollers 67 and 66 are mounted on the overflow container 51 and serves to guide a movement of the wire 64. The third guide roller 65 around which the wire 64 is retained is mounted on an upper surface of the refrigerator. The guide rollers 65, 66 and 67 guide a movement of the wire 64 in order to allow the delivery valve 54 to be vertically moved. The wire 64 connected to the delivery valve 53 at its one end is connected to the slider 63 reciprocating within the guide member 63'. One end of the slider 63 is connected to the wire 64 and the other end thereof is rotatably connected to one end of the intermediate link 62. The other end of the intermediate link 62 is rotatably connected one end of the rotation link 61. The other end of the rotational link 61 is fixed to an output shaft 74 of the switch box 79 to rotate therewith.

The switch box 70 includes a driving motor 71, a reduction gadget 72, an output gear 73, the output shaft 74, a switch actuator 75 and a first and a second switches 81 and 82. The reduction gadget 72 provided with a worm and a worm wheel and a plurality of connection gears 76 and 77 serves to reduce a RPM of the driving motor 71 to thereby transmit the rotational power to the output gear 73. The output shaft 74 extends from the output gear 73. The switch actuator 75 extends in a radial direction from the output shaft 74. The first switch 81 is so positioned nearby the output shaft 74 that the first switch 81 is depressed by the switch actuator 75 to be turned on, when the delivery valve 54 is in the closed state. The second switch 82 is so positioned nearby the output shaft 74 and separated from the first switch 81 that the second switch 82 is depressed by said switch actuator 75 to be turned on, when the delivery valve 54 is in the opened state. The switch actuator 75 turns on the first switch 81 and the second switch 82 by rotatively depressing the same, being rotated with the output shaft 73. On releasing the depression by the switch actuator 75, the first and the second switches 81 and 82 are turned off. When the first switch 81 is turned on by the switch actuator 75, the driving motor 71 rotates in a direction for effecting a counterclockwise rotation of the output gear 73. When the second switch 82 is depressed and turned on, the driving motor 71 rotates contrary to the previous rotation.

On the other hand, the whole operation of the inventive automatic ice making apparatus constructed in this manner is managed by a micro processor(not shown).

Water supplying process of the inventive automatic ice making apparatus is now described with reference to FIGS. 5A to 7C, wherein a first water supplying process refers to a process of supplying the water to the water regulation container 52 from the water container 41 and a second water supplying process refers to a process of supplying the water to the mold 31 from the water regulation container 52.

The first water supply begins with delivering the water kept in the water container 41 to the water regulation container 52 via the first water supply conduit 47 by the pump 43 driven by the water supply motor 42. The delivered water by the pump 43 fills the water regulation container 52 and the water beyond the required amount is drained into the overflow container 51 via the pair of lateral through holes 55, forcing the amount of the water in the water regulation container 52 is limited to the predetermined amount. For that effect, an amount of the water delivered by the pump 43 must be somewhat over-supplied to the water regulation container 52. The water charging the overflow container 51 is returned to the water container 41 via the recovery conduit 48.

The second water supplying process is now described with reference to FIGS. 5A to 5C. As shown, the output shaft 74 is rotated to allow the first switch 81 to be depressed by the switch actuator 75, allowing the rotational link 61 to be aligned in a straight line with the intermediate link 62 and the slider 63. Accordingly, the slider 63 is positioned on its lowest position, allowing the delivery valve 53 connected to the slider 63 via the wire 64 to close the drain hole 54. When the first switch 81 is turned on by the switch actuator 75, the micro processor rotates the driving motor 71 in a direction for effecting a counterclockwise rotation of the output gear 73. As a result, the delivery valve 53 begins to be raised, leaving the drain hole 53 opened. At this time, the water in the water regulation container 52 begins to be supplied to the mold 31 via the second water supply conduit 49.

Figure 6A:
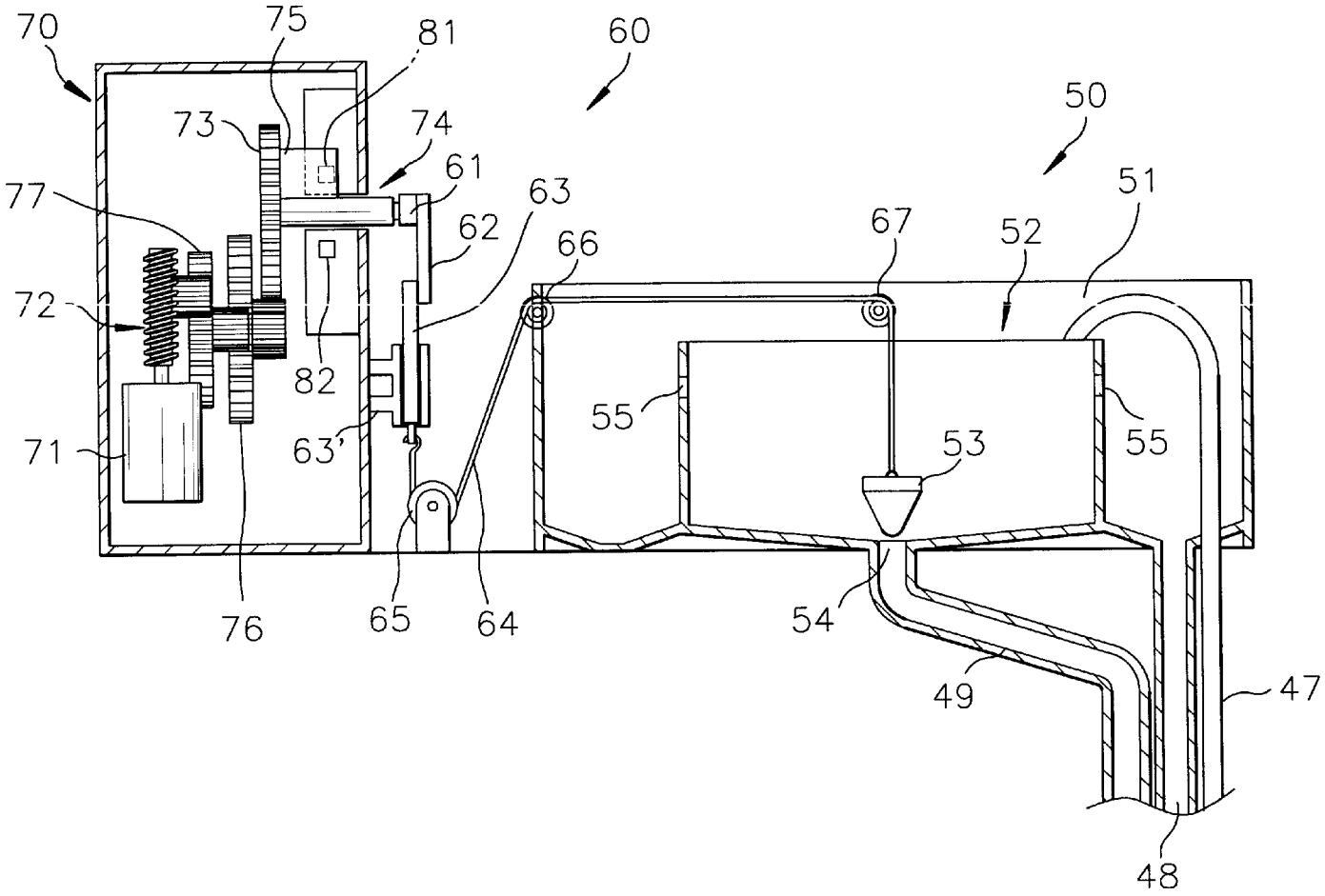
FIG. 6A illustrates the water limiter, the link and the switch box, when the refrigerator is viewed from the front thereof and the delivery valve is on a semi-opened state.
Figure 6B:
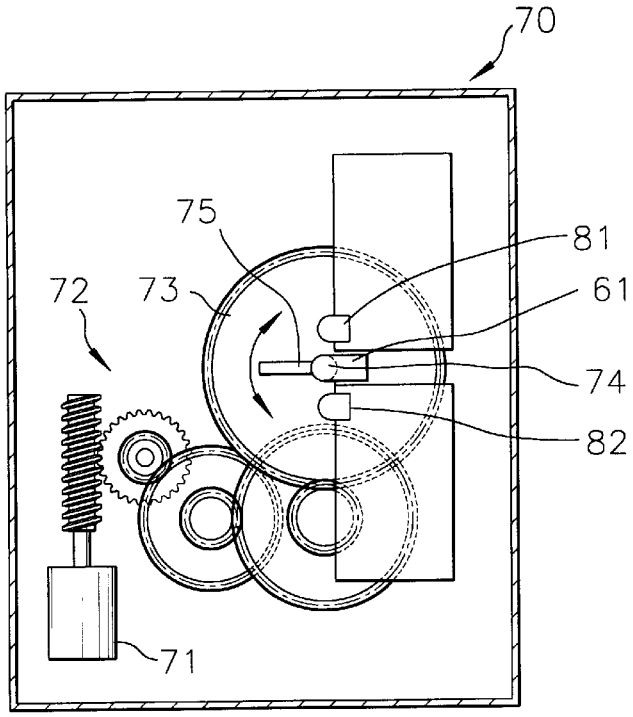
FIGS. 6B and 6C illustrate the switch box and the link employed in the inventive automatic ice making apparatus, respectively, when the delivery valve of the water limiter is on the semi-opened state.
Figure 6C:
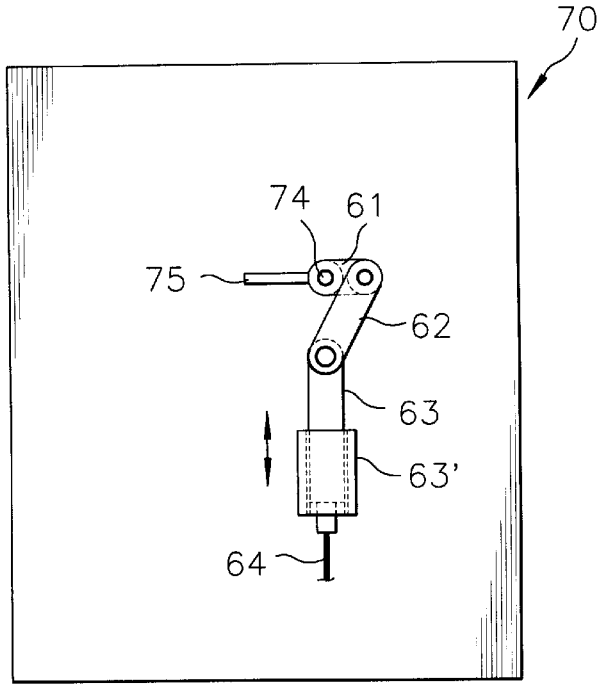

Referring to FIGS. 6A to 6C, the output gear 73 is rotated by 45° from the closed state of the drain hole 53 in FIGS. 5A to 5C, allowing the drain hole 53 to be in a semi-opened state. At this state, both the first and the second switches 81 and 82 are turned off.

Figure 7A:
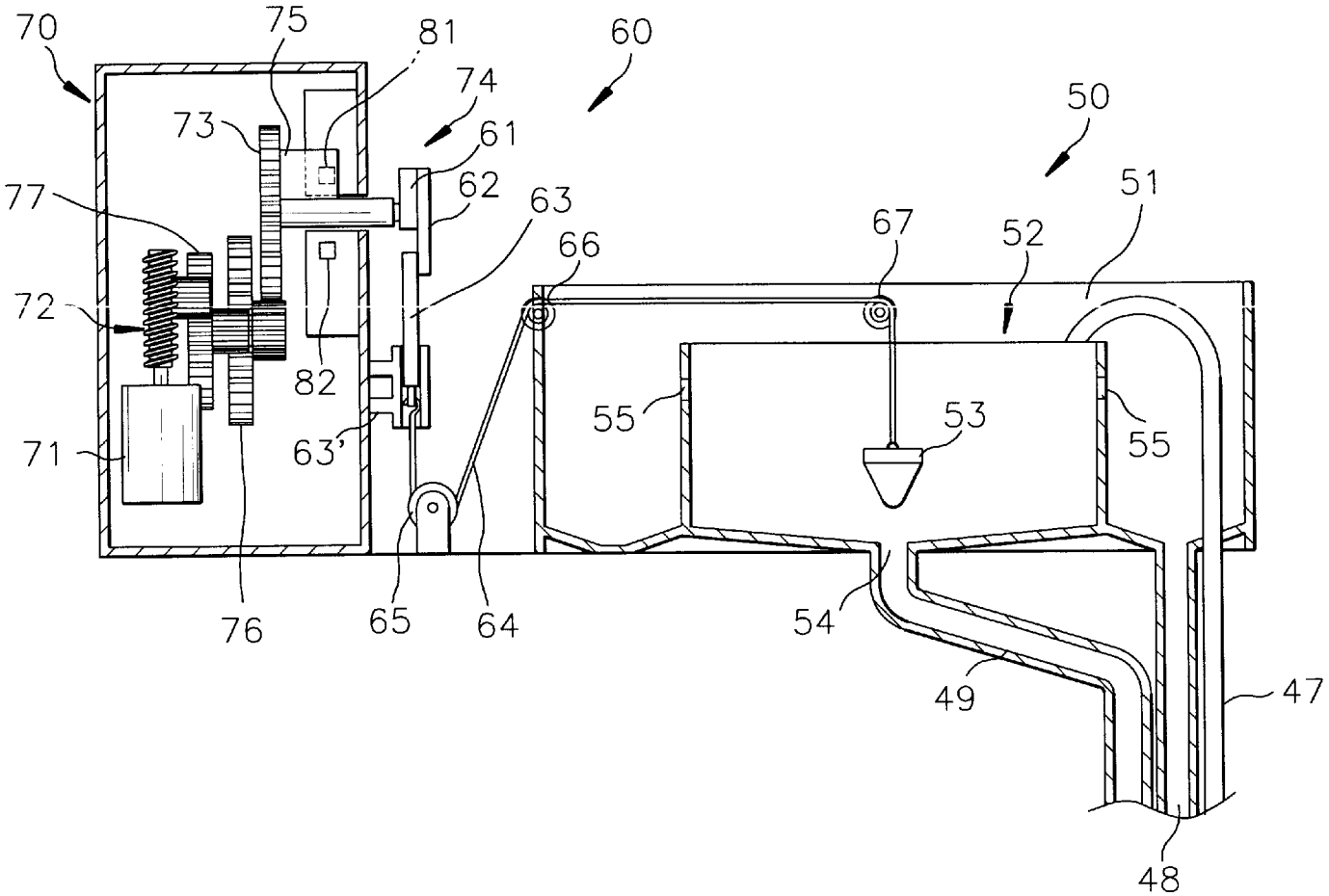
FIG. 7A illustrates the water limiter, the link and the switch box, when the refrigerator is viewed from the front thereof and the delivery valve is opened.
Figure 7B:
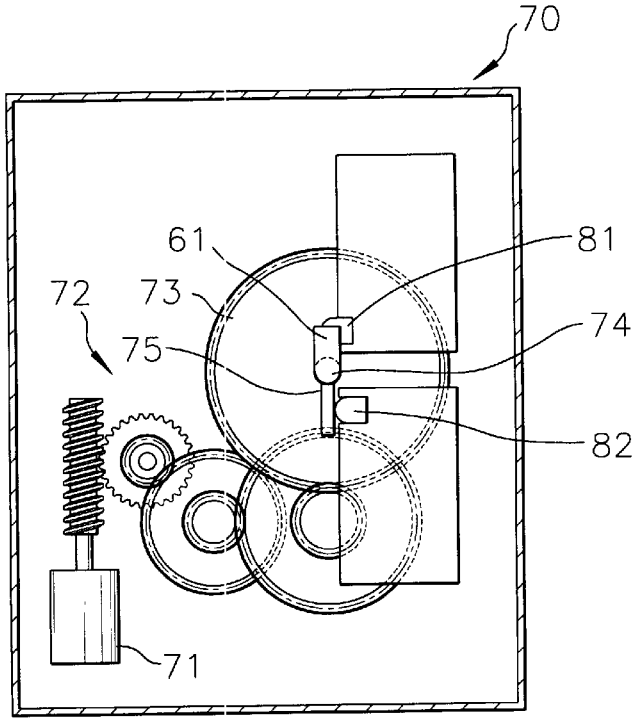
FIGS. 7B and 7C illustrate the switch box and the link employed in the inventive automatic ice making apparatus, when the delivery valve of the water limiter is opened.
Figure 7C:
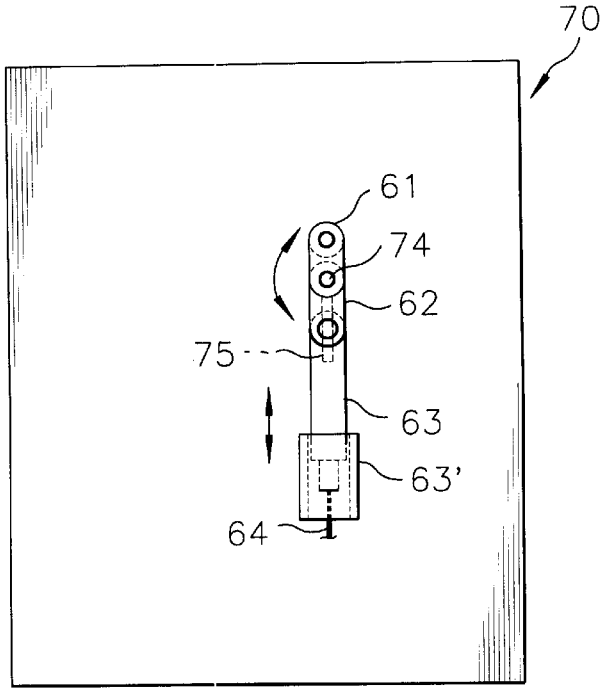

When the output gear 73 is further rotated by 45° from the state in FIGS. 6A to 6C, the delivery valve 53 is in a fully opened state, as shown in FIGS. 7A to 7C. The water in the water regulation container 52 is completely drained to the mold 31, leaving the water regulation container 52 empty. As shown in FIG. 7B, when the second switch 82 is turned on by the switch actuator 75, the micro processor rotates the driving motor 71 in a direction for effecting a clockwise rotation of the output gear 73. If the output gear 73 is rotated clockwise, the slider 73 moves down. As a result, the delivery valve 53 begins to be lowered to close the drain hole 53. While the output gear 73 is rotated clockwise, the delivery valve 53 arrives at the state in FIGS. 5A to 5C through the state shown in FIGS. 6A to 6C. When the first switch 81 is depressed again, the micro processor stops the rotation of the driving motor 71 and triggers the rotation of the water supply motor 42 for the first water supplying process. When the second water supplying process is completed, the water in the mold 31 begins to be frozen.

Although the invention has been shown and described with respect to the preferred embodiments, it will be understood by those skilled in the art that various changes and modifications may be made without departing from the spirit and scope of the invention as defined in the following claims.

What is claimed is:

1. An automatic ice making apparatus for use in a refrigerator having a water reservoir, a freezing chamber within which an ice cube is made, a freezing device for generating a chill air within the freezing chamber and a mold mounted within the freezing chamber, said apparatus comprising:

water limiting means capable of limiting water delivered thereto by keeping a predetermined amount of the water from the delivered water thereto, and discarding the remainder, the water limiting means being located above the mold;

water supplying means for supplying water in the water reservoir to the water limiting means;

delivery means for providing a path through which the water kept in the water limiting means is delivered to the mold; and path control means for opening and closing said path.

2. The apparatus of claim 1, further comprising recovery means for keeping the discarded water therein to return the discarded water to said water reservoir.

3. The apparatus of claim 2, wherein said water limiting means comprises:

a water regulation container capable of containing the water therein; and a pair of lateral holes formed on side portions of said water regulation container.

4. The apparatus of claim 3, wherein said water supply means comprises:

a water container adapted to receive the water from said water reservoir;

a pump for delivering the water in the water container to the water regulation container;

a water supply motor for driving said pump; and a first conduit through which the water in said water container is delivered to said water regulation container.

5. The apparatus of claim 4, wherein said delivery means comprises:

a drain hole formed through a bottom of said water regulation container; and a second conduit through which the water in said water regulation container is delivered to said mold.

6. The apparatus of claim 5, wherein said recovery means comprises:

an overflow container containing said water regulation container; and a recovery conduit through which the water in the overflow container is delivered to said water container, the recovery conduit adapted to communicate with said overflow container.

7. The apparatus of claim 6, wherein said path control means comprises:

rotation means for generating a rotational movement;

link means for converting said rotational movement to reciprocating linear movement;

a wire connected to said link means at its one end;

a delivery valve connected to the other end of the wire and being vertically movable between a closing state wherein the delivery valve is in a lowest position to close said drain hole and an opened state wherein the delivery valve is in an uppermost position to open said drain hole;

wire guide means for guiding a movement of said wire in order to allow the delivery valve to be vertically moved in response to said reciprocating linear movement; and switching means for controlling said rotation means in order to allow said delivery valve to be opened for a predetermined time.

8. The apparatus of claim 7, wherein said rotation means comprises:

a driving motor;

a worm and a worm wheel connected to said driving motor;

at least one connection gear engaged with said worm wheel;

an output gear engaged with the connection gear; and an output shaft extending from a center of said output gear.

9. The apparatus of claim 8, wherein said link means comprises:

a rotational link fixed to said output shaft to rotate therewith at its one end;

an intermediate link hinged with the other end of said rotational link at its one end;

a slider hinged with the other end of said intermediate link at its one end; and a slider guider for guiding said slider to allow said slider to be moved linearly therewithin.

10. The apparatus of claim 7, wherein said wire guide means comprises:

a first and a second guide rollers around which the wire is retained, said first and the second guide rollers being mounted to said overflow container; and a third guide roller around which the wire is retained, said third guide roller is mounted on an upper surface of the refrigerator.

11. The apparatus of claim 7, wherein said switching means comprises:

a switch actuator extending in a radial direction from the output shaft;

a first switch so positioned nearby said output shaft that the first switch is depressed by said switch actuator to be turned on, when the delivery valve is in the closed state;

a second switch so positioned nearby said output shaft and separated from said first switch that the second switch is depressed by said switch actuator to be turned on, when the delivery valve is in the opened state; and a micro processor electrically connected to said first and second switches, so that the micro processor rotates said driving motor in a direction for allowing said delivery valve to be raised, when said first switch is turned on, and reversely rotates said driving motor, when said second switch is turned on.

* * * * *